US006471481B2

(12) United States Patent
Chen

(10) Patent No.: US 6,471,481 B2
(45) Date of Patent: Oct. 29, 2002

(54) HUB ASSEMBLY FOR MARINE PROPELLER

(75) Inventor: Liheng Chen, Schaumburg, IL (US)

(73) Assignee: Turning Point Propellers, Inc., Schaumburg, IL (US)

( * ) Notice: Subject to any disclaimer, the term of this patent is extended or adjusted under 35 U.S.C. 154(b) by 0 days.

(21) Appl. No.: 09/753,366

(22) Filed: Jan. 2, 2001

(65) Prior Publication Data

US 2002/0085914 A1 Jul. 4, 2002

(51) Int. Cl.[7] ..... B63H 1/20

(52) U.S. Cl. ..... 416/134 R; 416/170 R; 416/244 B; 464/90; 464/91

(58) Field of Search ..... 416/93, 134 B, 416/170 R, 244 B; 464/74, 75, 90, 91

(56) References Cited

U.S. PATENT DOCUMENTS

| | | | | |
|---|---|---|---|---|
| 2,235,605 A | | 3/1941 | Bugatti | |
| 2,469,116 A | | 5/1949 | Kiekhaefer | |
| 2,556,151 A | | 6/1951 | Bremer | |
| 3,002,365 A | | 10/1961 | Liljequist | |
| 3,045,763 A | | 7/1962 | Perrott | |
| 3,701,611 A | | 10/1972 | Lambrecht | |
| 4,338,064 A | | 7/1982 | Carmel | |
| 4,452,591 A | | 6/1984 | Fishbaugh et al. | |
| 4,566,855 A | | 1/1986 | Costabile et al. | |
| 4,642,057 A | * | 2/1987 | Frazzell et al. | 440/52 |
| 4,826,404 A | | 5/1989 | Zwicky | |
| 4,898,552 A | | 2/1990 | Cochran | |
| 5,049,034 A | | 9/1991 | Cahoon | |
| 5,201,679 A | | 4/1993 | Velte, Jr. et al. | |
| 5,244,348 A | | 9/1993 | Karls et al. | |
| 5,252,028 A | | 10/1993 | LoBosco et al. | |
| 5,322,416 A | | 6/1994 | Karls et al. | |
| 5,908,284 A | | 6/1999 | Lin | |
| 5,967,751 A | | 10/1999 | Chen | |

FOREIGN PATENT DOCUMENTS

| | | |
|---|---|---|
| DE | 1152132 | 9/1967 |

* cited by examiner

*Primary Examiner*—Edward K. Look
*Assistant Examiner*—Ninh Nguyen
(74) *Attorney, Agent, or Firm*—Boyle Fredrickson Newholm Stein & Gratz S.C.

(57) ABSTRACT

A propeller assembly is provided for mounting on a rotatable propeller shaft of a watercraft. The propeller assembly includes a hub structure extending along a longitudinal axis. The hub structure includes an outer surface having a plurality of circumferentially spaced propeller blades projecting therefrom and an inner surface having a longitudinally extending keys projecting therealong. An adaptor has an inner surface defining a passageway for receiving the propeller shaft therethrough and an outer surface having longitudinally extending keys extending therealong. A tubular bushing interconnects the adaptor to the hub structure. The tubular bushing has a first set of keyways for receiving corresponding keys of the adaptor in a mating relationship and a second set of keyways for receiving the keys of the hub structure in a mating relationship.

21 Claims, 2 Drawing Sheets

FIG. 2
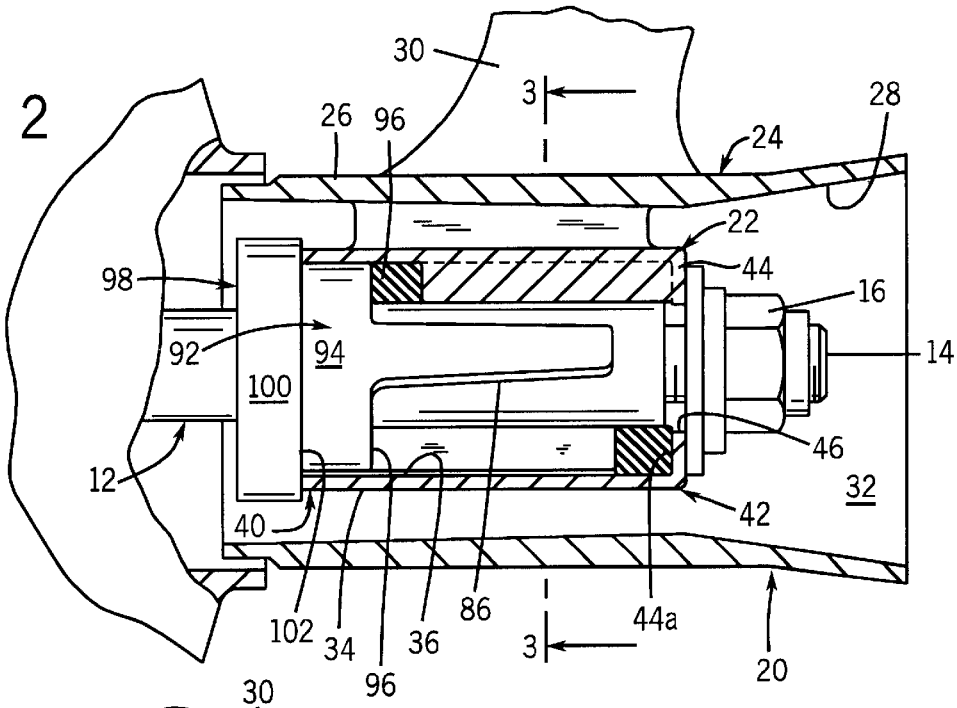
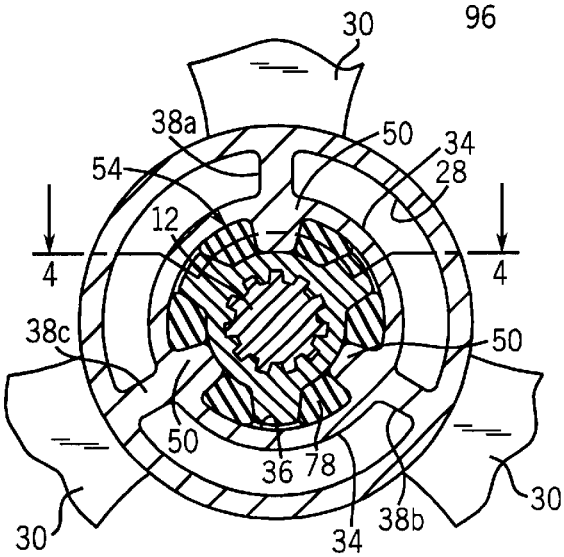
FIG. 3
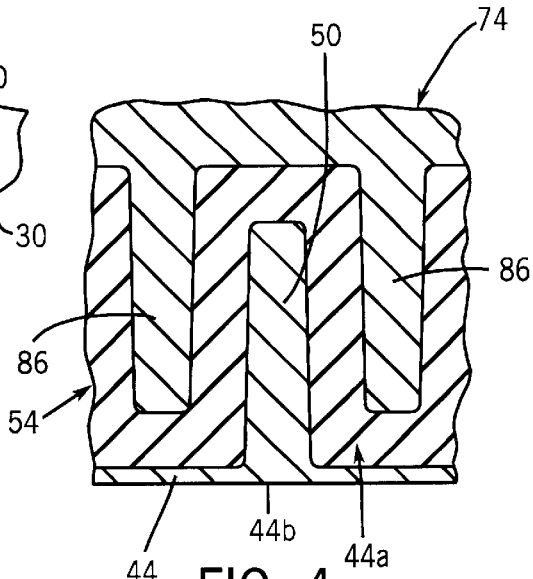
FIG. 4

HUB ASSEMBLY FOR MARINE PROPELLER

FIELD OF THE INVENTION

This invention relates to propellers, and in particular, to a hub assembly for translating rotational movement from a propeller shaft of a marine vehicle to the blades of a propeller.

BACKGROUND AND SUMMARY OF THE INVENTION

It is known to propel a marine vehicle utilizing a propeller assembly mounted on a rotatable shaft. The propeller assembly includes propeller blades extending from a central hub. A motor rotates the drive shaft which, in turn, rotates the central hub and the propeller blades. A hub assembly is provided to interconnect the central hub to the drive shaft. As is known, rotation of the propeller blades extending from the central hub propels the marine vehicle through the water.

Typically, the propeller assembly is constructed as a unit wherein the propeller blades, the central hub and the hub assembly are mounted or removed from the drive shaft in unison. Typically, the central hub of the propeller assembly includes an outer cylindrical housing which is welded or otherwise attached to a plurality of propeller blades. The central hub also includes an inner cylindrical housing which is co-axial with the outer cylindrical housing and radially spaced therefrom. The inner housing is supported within the outer housing by a plurality of circumferentially spaced ribs. The propeller assembly further includes a hub assembly disposed within the inner cylindrical housing of the propeller hub assembly. The hub assembly includes a drive member having an inner surface which meshes with splines on the outer surface of the drive shaft and an outer surface. A bushing formed from a rubber or elastomeric material is provided between the inner surface of the inner housing and the outer surface of the drive member. The elastomeric bushing provides shock absorbency between the propeller hub assembly and the drive shaft.

It has been found that slippage may occur between the elastomeric bushing and the inner surface of the inner housing. Once slippage has occurred, the outer surface of the elastomeric bushing may overheat and change its characteristics such that additional slippage becomes more common. Consequently, once slippage has occurred, it becomes necessary to replace the propeller assembly in order to once again realize the power capabilities of the motor of the marine vehicle.

In addition, it is known that the drive shafts driven by the various motors for marine vehicles differ depending upon the manufacture. Consequently, individual propellers must be provided for the drive shafts of each motor brand. Maintaining an inventory of specific propellers for each brand of motor requires significant storage space and may be cost prohibitive.

Therefore, it is a primary object and feature of the present invention to provide a hub assembly for a propeller which discourages slippage between the coupling element and the inner surface of the inner housing.

It is a still further object and feature of the present invention to provide a hub assembly for a propeller which may be easily adapted for mounting propellers on the drive shafts of different manufacturers' motors.

It is a still further object and feature of the present invention to provide a hub assembly for a propeller which is simple and inexpensive to manufacture.

In accordance with the present invention, a connection assembly is provided for interconnecting a propeller shaft to a central hub of a propeller assembly. The central hub extends along a longitudinal axis and includes an inner surface having a key extending therealong. The connection assembly includes an adaptor having an inner surface defining a passageway for receiving the propeller shaft therethrough and an outer surface having an longitudinally extending key extending therealong. The connection assembly further includes a tubular bushing having a first keyway for receiving the key of the adaptor in a mating relationship and a second keyway for receiving the key of the central hub in a mating relationship.

The inner surface of the adaptor may include a plurality of splines which form a mating relationship with the propeller shaft. The key of the adaptor has a first narrow end and a second wider end. Similarly, the first keyway of the bushing includes a first narrow end and a second wider end. The adaptor may include an enlarged head extending radially from a first end thereof. The enlarged head is engageable with the central hub. It is further contemplated that the adaptor include a stop member adjacent an end of the key of the adaptor for limiting insertion of the key of the adaptor into the first keyway of the bushing.

It is contemplated that the bushing be formed of a resilient material. A locking nut is mountable on the propeller shaft for retaining the adaptor and the bushing thereon. A washer is disposed on the propeller shaft adjacent the locking nut.

In accordance with a still further aspect of the present invention, a propeller assembly is provided for mounting on a rotatable propeller shaft of a water craft. The propeller assembly includes a hub structure extending along a longitudinal axis. The hub structure includes an outer surface having a plurality of circumferentially spaced blades projecting therefrom and an inner surface having a longitudinally extending key projecting therefrom. The propeller assembly also includes an adaptor having an inner surface defining a passageway for receiving the propeller shaft therethrough and an outer surface having a longitudinally extending key extending therealong. A tubular bushing is also provided. The tubular bushing has a first keyway for receiving the key of the adaptor in the mating relationship and a second keyway for receiving the key of the hub structure in a mating relationship.

The key of the adaptor has a first narrow end and a second wider end. Likewise, the first and second keyways of the tubular bushing include first narrow ends and second wider ends. In addition, the key of the hub structure has a first narrow end and a second wider end.

The adaptor may include an enlarged head extending radially from a first end thereof. The enlarged head of the adaptor is engageable with the. hub structure. A locking. nut is mountable on the propeller shaft for retaining the adaptor and the bushing thereon. A washer is disposed on the propeller shaft adjacent the locking nut.

In accordance with a still further aspect of the present invention, a propeller assembly is provided for mounting on a rotatable propeller shaft of a watercraft. The propeller assembly includes a central hub defining an inner surface having a plurality of circumferentially spaced keys therealong. An adaptor has an inner surface defining a passageway for receiving the propeller shaft therethrough and an outer surface having a plurality of circumferentially spaced keys therealong. A tubular bushing has a first end including a plurality of circumferentially spaced recesses therein which define keyways for receiving corresponding keys of the adaptor in a mating relationship and a second opposite end including a plurality of circumferentially spaced recesses therein which define keyways for receiving corresponding keys of the central hub in a mating relationship. Each of the keys of the central hub has a first narrow end and a second wider end. Likewise, each of the keys of the adaptor has a first narrow end and a second wider end. In addition, each of the keyways of the bushing includes a first narrow end and a second wider end.

The adaptor may include a stop member adjacent the wider ends of the keys of the adaptor for limiting the insertion of the keys of the adaptor into the keyways in the first end of the bushing. A washer and lock nut are mountable on the propeller shaft for retaining the adaptor and the bushing thereon.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 2 is a side elevational view, partially in section, showing the propeller assembly of the present invention;

FIG. 3 is a cross-sectional view of the propeller assembly of the present invention taken along line 3—3 of FIG. 2; and FIG. 4 is a cross-sectional view of the propeller assembly of the present invention taken along line 4—4 of FIG. 3.

DETAILED DESCRIPTION OF THE PREFERRED EMBODIMENT

Figure 1:
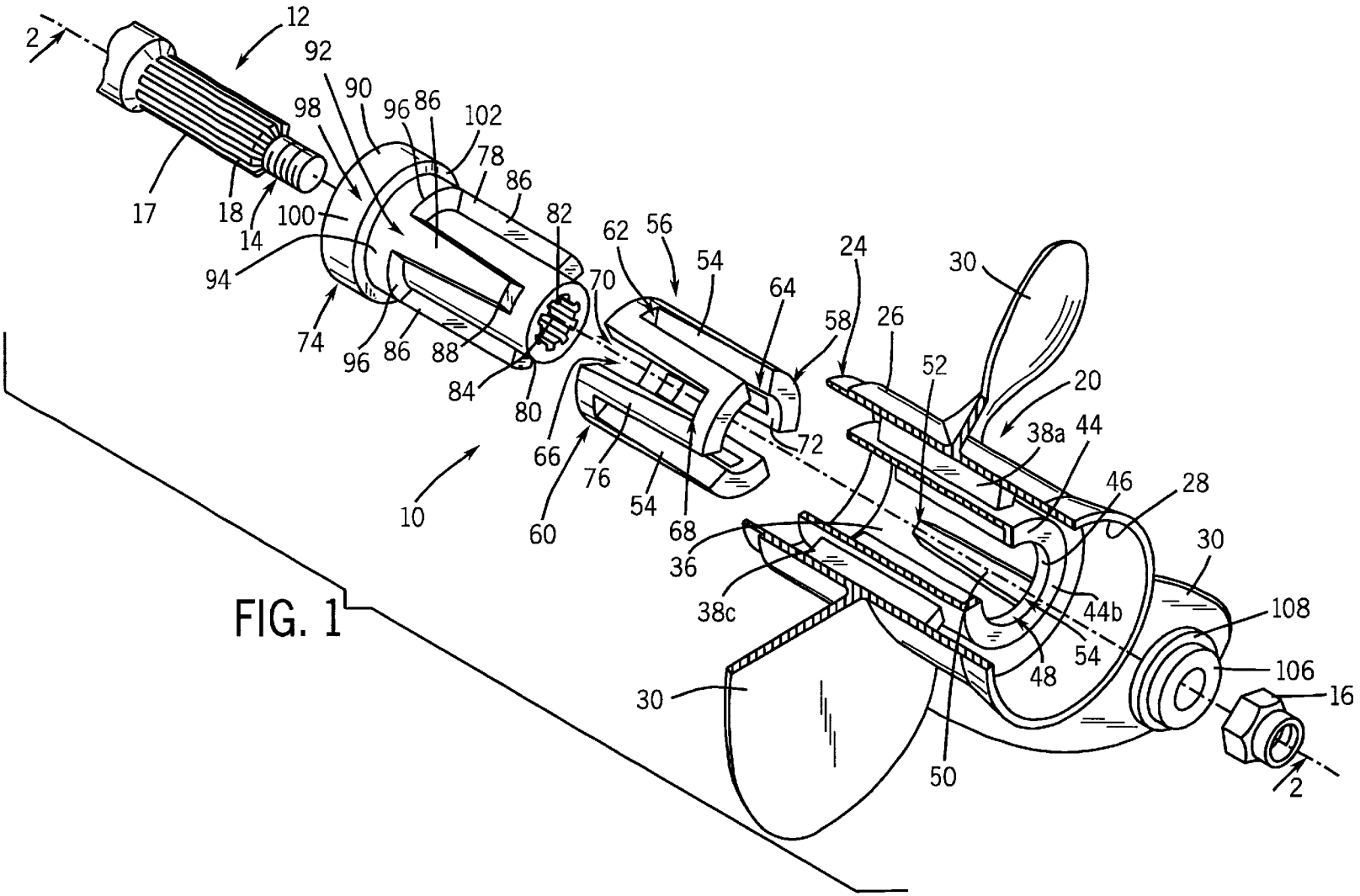
FIG. 1 is an exploded, isometric view of a propeller assembly in accordance with the present invention.

Referring to FIG. 1, a propeller assembly in accordance with the present invention is generally designated by the reference numeral 10. It is intended that propeller assembly 10 be mounted on a rotatable propeller shaft 12 which, in turn, is driven by a marine engine (not shown). Propeller shaft 12 extends along a longitudinal axis and terminates at a threaded terminal end 14 adapted for receiving a locking nut 16 thereon, for reasons hereinafter described. As is conventional, rotatable shaft 12 includes an outer surface 17 having longitudinally extending splines 18 therealong adjacent terminal end 14.

Referring to FIGS. 1 and 2, propeller assembly 10 includes a central hub 20 having an inner cylindrical housing 22 and an outer cylindrical housing 24. Outer housing 24 has an outer surface 26 and an inner surface 28. A plurality of circumferentially spaced propeller blades 30 project radially from outer surface 26 of outer housing 24. Inner surface 28 defines an inner housing receipt cavity 32.

Inner housing 22 is received within inner housing receipt cavity 32 defined by outer housing 24. Inner housing 22 includes an outer surface 34 and an inner surface 36. A plurality of circumferentially spaced connection spokes 38*a–c* extend between the outer surface 34 of inner housing 22 and the inner surface 28 of outer housing 24 so as to rigidly connect inner housing 22 to outer housing 24.

Inner housing 22 has a first end 40 and a second, opposite end 42. An end flange 44 projects radially inward from second end 42 of inner housing 22 and terminates at a radially inner surface 46 which defines a generally circular opening 48 in second end 42 of inner housing 22.

Inner surface 36 of inner housing 22 includes a plurality of circumferentially spaced, axially-extending keys 50. Each key 50 includes a first narrow end 52 and an opposite wider end 54 which abuts surface 44*a* of end flange 44 of inner housing 22. Keys 50 are dimensioned for receipt in corresponding inner housing keyways 54 in bushing 56.

Bushing 56 is formed from a resilient material and has first and second opposite ends 58 and 60, respectively. Each inner housing keyway 54 is defined by a first closed end 62 and a second open end 64 which is generally co-planar with first end 58 of bushing 56. It is contemplated that inner housing keyway 54 be narrower at closed end 62 than at open end 64 thereof such that inner housing keyways 54 may receive corresponding keys 50 along the inner surface 36 of inner housing 22 in a mating relationship.

Bushing 56 further includes a plurality of adaptor keyways 66. Each adaptor keyway 66 includes a first closed end 68 and a second open end 70 which is generally co-planar with second end 60 of bushing 56. It is contemplated that each adaptor keyway 66 be narrower at closed end 68 than at open end 70.

Bushing 56 includes an inner surface 72 which defines a passageway therethrough for receiving adaptor 74. Bushing 56 further includes an outer surface 76 which engages the inner surface 36 of inner housing 22, for reasons hereinafter described.

Adaptor 74 includes an outer surface 78 and an inner surface 80 which defines a passage 84 therethrough for receiving the splined portion of propeller shaft 12. Inner surface 80 of adaptor 74 includes a plurality of circumferentially spaced, longitudinally extending splines 82 therealong which mesh with splines 18 extending along propeller shaft 12: Outer surface 78 of adaptor 74 includes a plurality of circumferentially spaced, axially extending keys 86 projecting therefrom. Each key 86 includes a narrow end 88 and a wider end 90. Keys 86 of adaptor 74 are dimensioned for receipt in corresponding adaptor keyways 66 in bushing 56.

Adaptor 74 further includes a stop member 92 which extends radially from outer surface 78 and terminates at a radially outer surface 94. Stop member 92 includes radially extending stop surfaces 96 which project radially from outer surface 78 of adaptor 74 to outer surface 94. Radially-extending stop surfaces 96 extend between wider ends 90 of keys 86. Enlarged head 98 is formed adjacent stop member 92 of adaptor 74 and has a radially outer surface 100. Outer surface 100 of enlarged head 98 is radially spaced from outer surface 94 of stop member 92 by radially-extending sidewall 102.

In order to mount propeller assembly 10 on propeller shaft 12, propeller shaft 12 is inserted through passage 84 in adaptor 74 such that splines 18 along outer surface 17 of propeller shaft 12 mesh with corresponding splines 82 along the inner surface 80 of adaptor 74. Bushing 56 is slid axially onto adaptor 74 such that keys 86 extending along outer surface 78 of adaptor 74 are received within corresponding adaptor keyways 66 in bushing 56. Bushing 56 is slid onto adaptor 74 until such point that second end 60 of bushing 56 engages stop surfaces 96 of stop member 92. It can be appreciated that such construction prevents keys 86 of adaptor 74 from becoming wedged within corresponding adaptor keyways 66 in bushing 56. Central hub 20 is slid axially onto bushing 56 such that keys 50 extending along the inner surface 36 inner housing 22 are received within corresponding inner housing keyways 54 in bushing 56 such that first end 40 of inner housing 22 abuts sidewall 102 of enlarged, head 98 of adaptor 74. Central hub 20 is slid onto bushing 56 until such point that first end 58 of bushing 56 engages surface 44*a* of flange member 44.

With central hub 20 received on bushing 56, terminal end 14 of propeller shaft 12 extends through opening 48 defined by flange 44 of inner housing 22. Washer 106 is positioned on terminal end 14 of propeller shaft 12 such that an enlarged portion 108 of washer 106 overlaps opening 48 and engages outer surface 44*b* of flange 44 of inner housing 22. Locking nut 16 is threaded onto end 14 of propeller shaft 12 to secure propeller assembly 10 on propeller shaft 12. It is contemplated to reverse washer 106 such that a portion of washer 106 extends into opening 48 and such that enlarged portion 108 of washer 106 overlaps opening 48 and engages outer surface 44*b* of flange 44 of inner housing 22. As a result, washer 106 axially aligns propeller shaft 12 through inner housing 22.

It can be appreciated that propeller assembly 10 may be assembled as heretofore described prior to the mounting thereof on propeller shaft 12. In such manner, adaptor 74 may be modified so as to adapt to various types of propeller shafts 12 produced by different manufacturers. In other words, utilizing a modified adapter 74, propeller assembly 10 may be mounted on each of the various types of propeller shafts.

In operation, propeller shaft 12 is rotated by the motor of the marine vehicle. As propeller shaft 12 is rotated, such rotation is translated to propeller assembly 10 through bushing 56 and adaptor 74 combination as heretofore described. Rotation of the propeller blades 30 projecting from the outer surface 26 of outer housing 24 propels the marine vehicle through the water.

Various modes of carrying out the invention are contemplated as being within the scope of the following claims particularly pointing out and distinctly claiming the subject matter which is regarded as the invention.

I claim:

1. A connection assembly for interconnecting a propeller shaft to a central hub of a propeller, the central hub extending along a longitudinal axis and including an inner surface having a key extending therealong, comprising:

an adaptor having an inner surface defining a passageway for receiving the propeller shaft therethrough and an outer surface having a longitudinally extending key extending therealong; and a tubular bushing having first and second ends, the first end of the bushing including a first keyway recess for receiving the key of the adaptor in a mating relationship and the second end of the bushing including a second keyway recess for receiving the key of the central hub in a mating relationship;

wherein each of the first and second keyway recesses having an open end and a closed end.

2. The connection assembly of claim 1 wherein the inner surface of the adaptor includes a plurality of splines for forming a mating relationship with the propeller shaft.

3. The connection assembly of claim 1 wherein the bushing is formed from a resilient material.

4. The connection assembly of claim 1 wherein the adaptor includes an enlarged head extending radially from a first end thereof, the enlarged head engageable with the central hub.

5. The connection assembly of claim 1 further comprising a locking nut mountable on the propeller shaft for retaining the adaptor and the bushing thereon and a washer disposed on the propeller shaft adjacent the locking nut.

6. The connection assembly of claim 1 wherein the adaptor includes a stop member adjacent an end of the key of the adaptor for limiting insertion of the key of the adaptor into the first keyway of the bushing.

7. A propeller assembly for mounting on a rotatable propeller shaft of a watercraft, comprising:

a hub structure extending along a longitudinal axis, the hub structure including an outer surface having a plurality of circumferentially spaced blades projecting therefrom and an inner surface having a longitudinally extending key projecting therefrom;

an adaptor having an inner surface defining a passageway for receiving the propeller shaft therethrough and an outer surface having a longitudinally extending key extending therealong; and a tubular bushing having first and second ends, the first end of the bushing including a first keyway for receiving the key of the adaptor in a mating relationship and the second end of the busing including a second keyway for receiving the key of the hub structure in a mating relationship;

wherein each of the first and second keyway recesses having an open end and a closed end.

8. The propeller assembly of claim 7 wherein the bushing is formed from a resilient material.

9. The propeller assembly of claim 7 further comprising a locking nut mountable on the propeller shaft for retaining the adaptor and the bushing thereon and a washer disposed on the propeller shaft adjacent the locking nut.

10. A propeller assembly for mounting on a rotatable propeller shaft of a watercraft, comprising:

a central hub defining an inner surface having a plurality of circumferentially spaced keys therealong;

an adaptor having an inner surface defining a passageway for receiving the propeller shaft therethrough an outer surface having a plurality of circumferentially spaced keys therealong; and a tubular bushing having first end including a plurality of circumferentially spaced recesses therein which define keyways for receiving corresponding keys of the adaptor in a mating relationship and a second opposite end including a plurality of circumferentially spaced recesses therein which define keyways for receiving corresponding keys of the central hub in a mating relationship;

wherein each of the first and second keyway recesses having an open end and a closed end.

11. The propeller assembly of claim 10 further comprising a locking nut mountable on the propeller shaft for retaining the adaptor and the bushing thereon and a washer disposed on the propeller shaft adjacent the locking nut.

12. A connection assembly for interconnecting a propeller shaft to a central hub of a propeller, the central hub extending along a longitudinal axis and including an inner surface having a key extending therealong, comprising:

an adaptor having an inner surface defining a passageway for receiving the propeller shaft therethrough and an outer surface having a longitudinally extending key extending therealong, the key of the adaptor has a first narrow end and a second wider end; and a tubular bushing having a first keyway for receiving the key of the central hub in a mating relationship.

13. The connection assembly of claim 12 wherein the first keyway includes a first narrow end and a second wider end.

14. A propeller assembly for mounting on a rotatable propeller shaft of a watercraft, comprising:

a hub structure extending along a longitudinal axis, the hub structure including an outer surface having a plurality of circumferentially spaced blades projecting therefrom and an inner surface having a longitudinally extending key projecting therefrom;

an adaptor having an inner surface defining a passageway for receiving the propeller shaft therethrough and an outer surface having a longitudinally extending key extending therealong, the key of the adaptor has a first narrow end and a second wider end; and a tubular bushing having a first keyway for receiving the key of the adaptor in a mating relationship and a second keyway for receiving the key of the hub structure in a mating relationship.

15. The propeller assembly of claim 14 wherein the first keyway of the bushing includes a first narrow end and a second wider end.

16. A propeller assembly for mounting on a rotatable propeller shaft of a watercraft, comprising:

a hub structure extending along a longitudinal axis, the hub structure including an outer surface having a plurality of circumferentially spaced blades projecting therefrom and an inner surface having a longitudinally extending key projecting therefrom, the key of the hub structure has a first narrow end and a second wider end;

an adaptor having an inner surface defining a passageway for receiving the propeller shaft therethrough and. an outer surface having a longitudinally extending key extending therealong; and a tubular bushing having a first keyway for receiving the key of the adaptor in a mating relationship and a second keyway for receiving the key of the hub structure in a mating relationship.

17. The propeller assembly of claim 16 wherein the second keyway of the bushing includes a first narrow end and second wider end.

18. A propeller assembly for mounting on a rotatable propeller shaft of a watercraft, comprising:

a hub structure extending along a longitudinal axis, the hub structure including an outer surface having a plurality of circumferentially spaced blades projecting therefrom and an inner surface having a longitudinally extending key projecting therefrom;

an adaptor having an inner surface defining a passageway for receiving the propeller shaft therethrough and an outer surface having a longitudinally extending key extending therealong, the adaptor including an enlarged head extending radially from a first end thereof, the enlarged head engageable with inner surface of the hub structure; and a tubular bushing having a first keyway for receiving the key of the adaptor in a mating relationship and a second keyway for receiving the key of the hub structure in a mating relationship.

19. A propeller assembly for mounting on a rotatable shaft of a watercraft, comprising:

a central hub defining an inner surface having a plurality of circumferentially spaced keys therealong;

an adaptor having an inner surface defining a passageway for receiving the propeller shaft therethrough and an outer surface having a plurality of circumferentially spaced keys therealong; and a tubular bushing having first end including a plurality of circumferentially spaced recesses therein which define keyways for receiving corresponding keys of the adaptor in a mating relationship and a second opposite end including a plurality of circumferentially spaced recesses therein which define keyways for receiving corresponding keys of the central hub in a mating relationship;

wherein each of the keys of the central hub has a first narrow end and a second wider end and wherein each of the keys of the adaptor has a first narrow end and a second wider end.

20. The propeller assembly of claim 19 wherein each of the keyways of the bushing includes a first narrow end and a second wider end.

21. The propeller assembly of claim 19 wherein the adaptor includes a stop member adjacent the wider ends of the keys of the adaptor for limiting insertion of the keys of the adaptor into the keyways in the first end of the bushing.

* * * * *